US006206791B1

(12) United States Patent
Moriyama et al.

(10) Patent No.: US 6,206,791 B1
(45) **Date of Patent: *Mar. 27, 2001**

(54) FOUR PIECE SOLID GOLF BALL

(75) Inventors: Keiji Moriyama; Yoshinori Sano, both of Shirakawa (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/283,580

(22) Filed: Apr. 1, 1999

Related U.S. Application Data

(62) Division of application No. 08/995,003, filed on Dec. 19, 1997, now Pat. No. 5,980,396.

(30) Foreign Application Priority Data

Dec. 20, 1996 (JP) ..... 8-341102
Dec. 20, 1996 (JP) ..... 8-341105
May 1, 1997 (JP) ..... 9-113847

(51) Int. Cl.[7] ..... A63B 37/06
(52) U.S. Cl. ..... 473/376; 473/374
(58) Field of Search ..... 473/376, 378, 473/373, 374

(56) References Cited

U.S. PATENT DOCUMENTS 5,702,311 12/1997 Higuchi et al. .
5,733,205 3/1998 Higuchi et al. .
5,980,396 * 11/1999 Moriyama et al. ..... 473/376

FOREIGN PATENT DOCUMENTS 2300574 11/1996 (GB) .
2302036 1/1997 (GB) .
2311731 10/1997 (GB) .

* cited by examiner

*Primary Examiner*—Jeanette Chapman
*Assistant Examiner*—Raeann Gorden
(74) *Attorney, Agent, or Firm*—Birch, Stewart, Kolasch & Birch, LLP

(57) ABSTRACT

The present invention provides a four piece solid golf ball which exhibits long flight distance and excellent shot feel. The four piece solid golf ball of the present invention comprises:

a center (1), an intermediate layer (5)having two layers consisting of an inner layer (2) and an outer layer (3), formed on the center (1), and a cover (4) covering the intermediate layer (5), wherein the inner layer (2) and cover (4) are harder than the center (1) and the outer layer (3), so that the hardness distribution of the portions (1) to (4) is arranged to be soft—hard—soft—hard from the center (1) to the cover (4).

5 Claims, 1 Drawing Sheet

FOUR PIECE SOLID GOLF BALL

This application is a divisional of Application Ser. No. 08/995,003, filed on Dec. 19, 1997, now U.S. Pat. No. 5,980,396 the entire contents of which are hereby incorporated by reference.

FIELD OF THE INVENTION

The present invention relates to a four piece solid golf ball having good flight performance and good shot feel at the time of hitting. More particularly, it relates to a four piece solid golf ball having high launch angle when hitting.

BACKGROUND OF THE INVENTION

Golf balls are generally classified into two, one of which is a thread wound golf ball and the other is a solid golf ball. A representative example of the solid golf balls is a two piece solid golf ball which is composed of a solid center formed from vulcanized rubber and a cover formed on the center and made from thermoplastic resin.

Although the two piece solid golf ball has such a simple structure as mentioned above, it has very good performance in flight distance and durability and therefore has been approved by lots of amateur golfers. However, the two piece solid golf ball has high hardness and exhibits poor shot feel at the time of hitting and poor controllability at approach shot.

For improving the defects of the two piece solid golf ball, much effort has been paid and it has been proposed as the result of the study either that the core is made two layers or that the cover is made two layers. These methods improve the shot feel to some degree, but do not improve the other defects and the shot feel is also desired to be improved more.

OBJECTS OF THE INVENTION

The present invention is to provide a solid golf ball which solves the above mentioned defects and shows good shot feel at the time of hitting and long flight distance.

This object as well as other objects and advantages of the present invention will become apparent to those skilled in the art from the following description with reference to the accompanying drawing.

SUMMARY OF THE INVENTION

Figure 1:
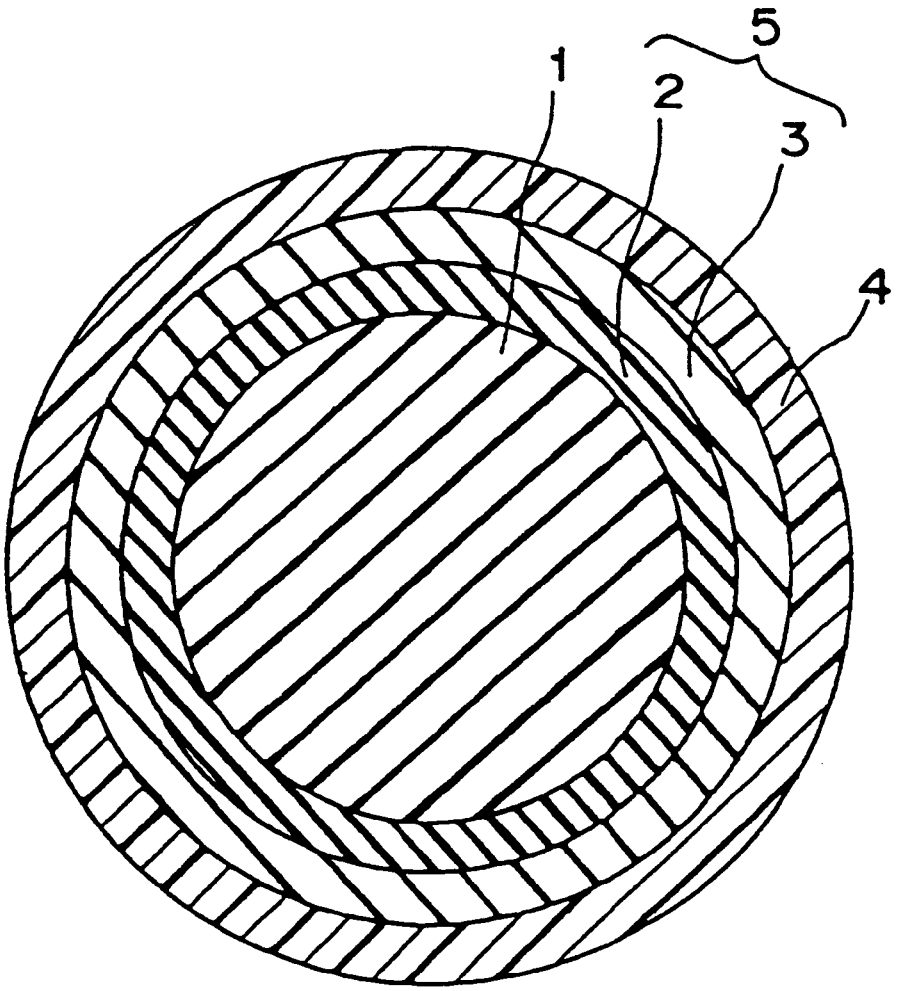
FIG. 1 is a drawing which shows a schematic cross section of an embodiment of the golf ball of the present invention.

The present inventors have intensely studied for achieving the above object and have found that the solid golf ball is made four piece and composed of a center, an intermediate layer having two layers and a cover covering the intermediate layer and that their hardness is controlled as soft-hard-soft-hard in the order of center-inner intermediate layer-outer intermediate layer-cover, which enlarges a launch angle of the golf ball when hitting and enhances flight performance, while keeping soft shot feel.

The four piece solid golf ball of the present invention comprises:

a center (1), an intermediate layer (5)having two layers consisting of an inner layer (2) and an outer layer (3), formed on the center (1), and a cover (4) covering the intermediate layer (5), wherein the inner layer (2) and cover (4) are harder than the center (1) and the outer layer (3), so that the hardness distribution of the portions (1) to (4) is arranged to be soft—hard—soft—hard from the center (1) to the cover (4).

DETAILED DESCRIPTION OF THE INVENTION

The present invention is explained with reference to FIG. 1 which shows a cross sectional view of one embodiment of the four piece solid golf ball of the present invention. The four piece solid golf ball is composed of a center (1), an intermediate layer (5) formed on the center (1) and a cover (4) formed on the intermediate layer (5). The intermediate layer is composed of an inner layer (2) and an outer layer (3). In the present invention, the inner layer (2) and the cover (4) are harder than the center (1) and the outer layer (3), so that the hardness distribution of the portions (1) to (4) is arranged soft—hard—soft—hard from the center (1) to the cover (4). As long as the hardness distribution is controlled as above, the materials for producing each part of the four portions can be any one which has been used for golf balls, for example vulcanized rubber, thermoplastic resin (especially ionomer resin), thermoplastic elastomer and a mixture thereof. In order to realize the hardness distribution, the following three combinations are proposed for selecting the producing materials:

(A)
- Center=vulcanized rubber
- Inner intermediate layer=thermoplastic resin (e.g. ionomer resin)
- Outer intermediate layer=vulcanized rubber
- Cover=thermoplastic resin (e.g. ionomer resin)

(B)
- Center=vulcanized rubber
- Inner intermediate layer=vulcanized rubber
- Outer intermediate layer=thermoplastic elastomer or a mixture of thermoplastic elastomer and thermoplastic resin (e.g. ionomer resin)
- Cover=thermoplastic resin (e.g. ionomer resin)

(C)
- Center=vulcanized rubber
- Inner intermediate layer=thermoplastic resin, thermoplastic elastomer or a mixture of thermoplastic elastomer and thermoplastic resin (e.g. ionomer resin)
- Outer intermediate layer=thermoplastic elastomer or a mixture of thermoplastic elastomer and thermoplastic resin (e.g. ionomer resin)
- Cover=thermoplastic resin (e.g. ionomer resin)

As is apparent from the above combinations, the center is preferably formed from vulcanized rubber for imparting superior flight performance to the golf ball and the cover is preferably formed from thermoplastic resin, especially ionomer resin for providing the golf ball with strong durability. For intermediate layer, there are many combinations as suggested above. The producing materials are firstly explained.

(Vulcanized rubber)

The vulcanized rubber may be formed by vulcanizing a rubber composition. The hardness of the vulcanized rubber can be easily controlled by selecting ingredient, changing the formulating amount of the ingredient and changing condition for vulcanization. The rubber composition can be one which has been known to the art, but generally comprises a base rubber, a crosslinking agent, a metal salt of unsaturated carboxylic acid, filler and optionally antioxidant. The base rubber employed can be one which has been used for solid golf ball, but includes natural rubber and/or synthetic rubber. Examples of the synthetic rubbers are butadiene rubber, polyisoprene rubber, styrene-butadiene rubber, ethylene-propylene-diene rubber and the like. Preferred is butadiene rubber having cis-1,4 bond of at least 40%, preferably at least 80%.

The crosslinking agent can be one which has been employed for the rubber composition of the golf ball, but includes an organic peroxide, such as dicumyl peroxide and t-butyl peroxide. Preferred is dicumyl peroxide. The crosslinking agent may be contained in the rubber composition in an amount of 1.0 to 2.0 parts by weight based on 100 parts by weight of the base rubber. Amounts of less than 1.0 parts by weight soften the rubber too much and reduce rebound characteristics, to result in poor flight distance. Those of more than 2.0 parts by weight harden the rubber too much and reduce shot feel.

The metal salt of unsaturated carboxylic acid is functioned as co-crosslinking agent. The αβ-unsaturated carboxylic acid may have 3 to 8 carbon atoms and examples thereof can be acrylic acid and methacrylic acid. The metal for forming a metal salt of unsaturated carboxylic acid can be monovalent metal or divalent metal, such as sodium, potassium, lithium, magnesium, zinc and the like. The metal salt of αβ-unsaturated carboxylic acid may be formed in the rubber composition in which αβ-unsaturated carboxylic acid is formulated with metal oxide to react. An amount of the metal salt of αβ-unsaturated carboxylic acid may be 15 to 30 parts by weight, based on 100 parts by weight of the base rubber. Amounts of more than 30 parts by weight harden the rubber too much and deteriorate shot feel and those of less than 15 parts by weight reduce rebound characteristics and reduce flight distance.

The filler can be one which has been used for the rubber composition of the core of the solid golf ball and includes inorganic salt, such as zinc oxide, barium sulfate, calcium carbonate etc.; metal powder having high specific gravity, such as tungsten powder, molybdenum powder etc.; and a mixture thereof. The rubber composition may further contain antioxidant or peptizer if necessary.

The rubber composition is prepared by mixing the above components by a conventional mixer, such as mixing roller, banbary mixer and the like. The resulting rubber composition is generally vulcanized in a mold at a temperature of 120 to 170° C.

(Thermoplastic resin)

The thermoplastic resin can generally be ionomer resin in the field of golf balls, but the other thermoplastic resins, such as polyester, polyurethane, polyamide, polyimide, polyolefin and the like, can also be used. Especially, the cover of the four piece solid golf ball of the present invention is mainly formed from the ionomer resin. The ionomer resin can be one which has been used for the cover material of solid golf balls. The ionomer resin can be an ethylene-(meth)acrylic acid copolymer of which a portion of carboxylic acid groups is neutralized with metal ion. Examples of the metal ions are alkali metal ion, such as Na ion, K ion, Li ion etc.; divalent metal ion, such as Zn ion, Ca ion, Mg ion etc.; trivalent metal ion, such as Al ion, Nd ion etc.; and a mixture thereof. Preferred are Na ion, Zn ion and Li ion, in view of rebound characteristics and durability. The ionomer resin is generally commercially available and includes Hi-milan 1557, 1605, 1652, 1705, 1706, 1707, 1855 and 1856 available from Mitsui Du Pont Polychemical Co., Ltd. and IOTEC 7010 and 800 available from Exxon Co.

In case of using the ionomer resin as cover material, the cover material may contains a filler, a colorant or an additive. Examples of the fillers are barium sulfate and the like. Examples of the colorants are titanium dioxide and the like. Examples of the additives are UV absorber, light stabilizer, fluorescent material or fluorescent whitener. The other material can be contained in the cover resin composition in such an amount that the characteristics of the cover is not damaged. The colorant may be present in an amount of 0.1 to 0.5 parts by weight based on 100 parts by weight of ionomer resin.

The cover may be formed by a method known to the art, for example injection molding or press molding. When forming a cover layer, many recesses, generally referred as "dimples", are formed thereon. The golf ball is generally coated with a paint and marked with brand name or other informations to impart good appearance and to enhance product quality.

(Thermoplastic elastomer)

The thermoplastic elastomer is a material which shows the characteristics of vulcanized rubber at room temperature but shows thermoplastic characteristics at an elevated temperature. The thermoplastic elastomer has soft segment showing rubber characteristics and hard segment preventing from plastic deformation in one molecule. The thermoplastic elastomer generally includes polystyrene type, polyamide type, polyolefin type, polyester type, polyurethane type, 1,2-polybutadiene type, polyvinyl chloride type and the like. Preferred are polyurethane type thermoplastic elastomer and styrene-butadiene-styrene block copolymer having polybutadiene block with epoxy groups.

When the thermoplastic elastomer is used, it has thermoplastic properties at an elevated temperature and can be easily molded by conventional molding method, such as injection-molding or press molding.

(Mixture of thermoplastic resin and thermoplastic elastomer)

The mixture can be any mixing ratio depending on which performance is made main. For example, if the performance of the thermoplastic elastomer is mainly used, the thermoplastic elastomer is mainly contained and the thermoplastic resin may be contained in an amount of less than 50 parts by weight based on 100 parts by weight of the thermoplastic elastomer. If the performance of the thermoplastic resin is mainly used, the thermoplastic elastomer may be contained in an amount of less than 50 parts by weight of 100 parts by weight of the thermoplastic resin. In case of using ionomer resin as the thermoplastic resin to be mixed with the thermoplastic elastomer, the ionomer resin may preferably be one having relatively high melt index, such as Surlyn AD 8511 and 8512 available from Du Pont Co.

(Golf ball)

The four piece solid golf ball of the present invention shows excellent flight performance and soft shot feel at the time of hitting, so long as the hardness distribution is controlled as soft—hard—soft—hard from the center (1) to the cover (4), but there is the following three concrete embodiments in view of practical object. The present invention will be explained in more details using the concrete embodiments.

The first one is a four piece solid golf ball in which the center (1) has a JIS-C hardness of 60 to 80 and a diameter of 15 to 30 mm, the inner layer (2) has a JIS-C hardness of 90 to 100 and a thickness of 1 to 3 mm, the outer layer (3) has a JIS-C hardness of 60 to 80 and a thickness of 2 to 12 mm and the cover (4) has a Shore D hardness of 62 to 72 and a thickness of 1 to 3 mm, wherein the inner layer (2) is harder than the center by 15 to 35 in JIS-C hardness and the outer layer (3) is softer than the inner layer (2) by 10 to 35 in JIS-C hardness.

The second one is a four piece solid golf ball in which the center (1) has a JIS-C hardness of 65 to 80 and a diameter of 15 to 25 mm, the inner layer (2) has a JIS-C hardness of 70 to 85 and a thickness of 2 to 13 mm, the outer layer (3) has a JIS-C hardness of 40 to 80 and a thickness of 1.3 to 2.5 mm and the cover (4) has a Shore D hardness of 62 to 72 and a thickness of 1.7 to 2.9 mm, wherein the inner layer (2) is harder than the center (1) by 5 to 20 in JIS-C hardness and the outer layer (3) is softer than the inner layer (2) by 10 to 35 in JIS-C hardness.

The third one is a four piece solid golf ball in which the center (1) has a JIS-C hardness of 50 to 80 and a diameter of 30 to 35 mm, the inner layer (2) has a JIS-C hardness of 70 to 100 and a thickness of 0.5 to 2.5 mm, the outer layer (3) has a JIS-C hardness of 40 to 80 and a thickness of 0.5 to 2.5 mm and the cover (4) has a Shore D hardness of 62 to 72 and a thickness of 1.0 to 3.0 mm, wherein the inner layer (2) is harder than the center (1) by 15 to 35 in JIS-C hardness and the outer layer (3) is softer than the inner layer (2) by 10 to 50 in JIS-C hardness.

The First Embodiment

In this embodiment, the center has a JIS-C hardness of 60 to 80 and a diameter of 15 to 30 mm. If the JIS-C hardness is less than 60, the center is too soft and the golf ball has poor rebound performance and if it is more than 80, the center is too hard and the golf ball shows poor shot feel. If the diameter is less than 15 mm, it is difficult to feel soft shot event if the center is made soft. If it is more than 30 mm, the rebound performance of the golf ball significantly reduces and flight distance reduces.

The center is covered with the inner layer (2) of the intermediate layer (5) and the hardness difference therebetween is controlled within the range of 15 to 35 in JIS-C hardness. The inner layer (2) in the first embodiment may preferably be formed from thermoplastic resin, especially ionomer resin. The inner layer (2) may be formed by the same method for forming a cover, such as injection-molding or press-molding.

The inner layer (2) has a thickness of 1 to 3 mm and a JIS-C hardness of 90 to 100, which enlarges the launch angle of a golf ball. If the thickness is less than 1.0 mm, rebound performance reduces and if it is more than 3.0 mm, shot feel is hard.

On the inner layer (2), an outer layer (3) is formed, which has a thickness of 2 to 12 mm and a JIS-C hardness of 60 to 80. The inner layer (2) and the outer layer (3) constitutes the intermediate layer (5). The outer layer can be obtained by any material as long as it has the JIS-C hardness range, but is generally formed by vulcanizing a rubber composition which is the same one as that used for the center (1) and thus contains a base rubber, a crosslinking agent, a metal salt of $\alpha\beta$-unsaturated carboxylic acid, filler and optionally antioxidant. If the outer layer has a thickness of less than 2 mm, shot feel is hard and if it is more than 12 mm, rebound performance reduces. The outer layer (3) may be formed by art-known methods, for example a method comprising preparing two half shells from the rubber composition and putting the inner layer covered center into the shells, followed by vulcanizing. The outer layer (3) may be formed by injection-molding the rubber composition and then vulcanizing.

In the first embodiment, the outer layer (3) is softer than the inner layer (2) by 10 to 35, preferably 15 to 30 in JIS-C hardness. If the difference is less than 10, the resulting golf ball is poor in shot feel. If it is more than 35, the resulting golf ball is poor in flight distance.

The intermediate layer-covered center is then covered with a cover (4) which has a thickness of 1 to 3 mm and a Shore D hardness of 62 to 72. If the thickness is less than 1 mm, rebound performance reduces and flight distance also reduces. If it is more than 3 mm, shot feel is hard. If the Shore D hardness is less than 62, the resulting golf ball is poor in flight distance. If it is more than 72, the resulting golf ball is poor in shot feel.

The Second Embodiment

In the second embodiment, a four piece solid golf ball comprises a center (1), an intermediate layer (5)having two layers consisting of an inner layer (2) and an outer layer (3), formed on the center (1), and a cover (4) covering the intermediate layer (5), wherein the center (1) has a JIS-C hardness of 65 to 80 and a diameter of 15 to 25 mm, the inner layer (2) has a JIS-C hardness of 70 to 85 and a thickness of 2 to 13 mm, the outer layer (3) has a JIS-C hardness of 40 to 80 and a thickness of 1.3 to 2.5 mm and the cover (4) has a Shore D hardness of 62 to 72 and a thickness of 1.7 to 2.9 mm, wherein the inner layer (2) is harder than the center (1) by 5 to 20 in JIS-C hardness and the outer layer (3) is softer than the inner layer (2) by 10 to 35 in JIS-C hardness.

In the second embodiment, the center (1) has a JIS-C hardness of 65 to 80 and a diameter of 15 to 25 mm. If the JIS-C hardness is less than 65, the center is too soft and the golf ball has poor rebound performance and if it is more than 80, the center is too hard and the golf ball shows poor shot feel. If the diameter is less than 15 mm, it is difficult to feel soft shot event if the center is made soft. If it is more than 25 mm, the rebound performance of the golf ball significantly reduces and flight distance reduces.

The inner layer (2) has a thickness of 2 to 13 mm and a JIS-C hardness of 70 to 85, which enlarges the launch angle of a golf ball. If the thickness is less than 2.0 mm, rebound performance reduces and if it is more than 3.0 mm, shot feel is hard. The producing material of the inner layer (2) in the second embodiment is not limited so long as the hardness is controlled as above, but preferably is formed from vulcanized rubber. The vulcanized rubber is explained above in detail.

In the second embodiment, the hardness difference between the center (1) and the inner layer (2) is controlled within the range of 5 to 20, preferably 5 to 15 in JIS-C hardness. If the difference is less than 5, the resulting golf ball is poor in flight distance. If it is more than 20, the resulting golf ball is poor in flight distance.

The outer layer (3) has a thickness of 1.3 to 2.5 mm and a JIS-C hardness of 40 to 80. If the outer layer has a thickness of less than 1.3 mm, shot feel is hard and if it is more than 2.5 mm, rebound performance reduces. The outer layer can be formed from any material so long as the hardness is controlled as above, but is preferably formed from thermoplastic elastomer or a combination of thermoplastic resin and thermoplastic elastomer.

In the second embodiment, the outer layer (3) is softer than the inner layer (2) by 10 to 35, preferably 10 to 30 in JIS-C hardness. If the difference is less than 10, the resulting golf ball is poor in shot feel. If it is more than 35, the resulting golf ball is poor in flight distance.

The cover has a thickness of 1.7 to 2.9 mm and a Shore D hardness of 62 to 72. If the thickness is less than 1.7 mm, rebound performance reduces and flight distance also reduces. If it is more than 2.9 mm, shot feel is hard. If the Shore D hardness is less than 62, the resulting golf ball is poor in flight distance. If it is more than 72, the resulting golf ball is poor in shot feel.

The Third Embodiment

In the third embodiment, a four piece solid golf ball comprises a center (1), an intermediate layer (5)having two layers consisting of an inner layer (2) and an outer layer (3), formed on the center (1), and a cover (4) covering the intermediate layer (5), wherein the center (1) has a JIS-C hardness of 50 to 80 and a diameter of 30 to 35 mm, the inner layer (2) has a JIS-C hardness of 70 to 100 and a thickness of 0.5 to 2.5 mm, the outer layer (3) has a JIS-C hardness of 40 to 80 and a thickness of 0.5 to 2.5 mm and the cover (4) has a Shore D hardness of 62 to 72 and a thickness of 1.0 to 3.0 mm, wherein the inner layer (2) is harder than the center (1) by 15 to 30 in JIS-C hardness and the outer layer (3) is softer than the inner layer (2) by 10 to 50 in JIS-C hardness.

In the third embodiment, the center (1) has a JIS-C hardness of 50 to 80 and a diameter of 30 to 35 mm. If the JIS-C hardness is less than 50, the center is too soft and the golf ball has poor rebound performance and if it is more than 80, the center is too hard and the golf ball shows poor shot feel. If the diameter is less than 30 mm, it is difficult to feel soft shot event if the center is made soft. If it is more than 35 mm, the rebound performance of the golf ball significantly reduces and flight distance reduces.

The inner layer (2) has a thickness of 0.5 to 2.5 mm and a JIS-C hardness of 70 to 100, which enlarges the launch angle of a golf ball. If the thickness is less than 0.5 mm, rebound performance reduces and if it is more than 2.5 mm, shot feel is hard.

In the third embodiment, the hardness difference between the inner layer (2) and the center (1) is controlled within the range of 15 to 35, preferably 20 to 35 in JIS-C hardness. If the difference is less than 5, the resulting golf ball is poor in flight distance. If it is more than 20, the resulting golf ball is poor in flight distance.

The outer layer (3) has a thickness of 0.5 to 2.5 mm and a JIS-C hardness of 40 to 80. If the outer layer has a thickness of less than 0.5 mm, shot feel is hard and if it is more than 2.5 mm, rebound performance reduces.

In the third embodiment, the outer layer (3) is softer than the inner layer (2) by 10 to 50, preferably 20 to 40 in JIS-C hardness. If the difference is less than 10, the resulting golf ball is poor in shot feel. If it is more than 50, the resulting golf ball is poor in flight distance.

In the third embodiment, the inner layer and the outer layer can be formed from any material so long as the hardness is controlled as above, but is preferably formed from thermoplastic resin, thermoplastic elastomer or a combination of thermoplastic resin and thermoplastic elastomer.

The center has a thickness of 1.0 to 3.0 mm and a Shore D hardness of 62 to 72. If the thickness is less than 1.0 mm, rebound performance reduces and flight distance also reduces. If it is more than 3.0 mm, shot feel is hard. If the Shore D hardness is less than 62, the resulting golf ball is poor in flight distance. If it is more than 72, the resulting golf ball is poor in shot feel.

EXAMPLES

The following Examples and Comparative Examples further illustrate the present invention in detail but are not to be construed to limit the scope of the present invention to their details.

Examples 1 to 6

Preparation of a Center

A composition for center was prepared by mixing the ingredients shown in Table 1 and then press-molded at 140° C. for 25 minutes, followed by press-molding at 165° C. for 20 minutes to form a center. The diameter and JIS-C hardness are shown in Table 2.

Formation of an Inner Layer of an Intermediate Layer

The center obtained above was covered by injection molding with the resin composition for inner layer, of which ingredients were shown in Table 1. The thickness and JIS-C hardness of the inner layer are shown in Table 2.

Formation of an Outer layer of an Intermediate Layer

On the inner layer-covered center, a rubber composition for outer layer was covered and then press-molded at 155° C. for 20 minutes. The ingredients of the rubber composition are shown in Table 1. The thickness and JIS-C hardness of the outer layer are shown in Table 2.

Formation of a Cover

On the outer layer-covered center, a resin composition for cover was covered by injection molding and then painted thereon to obtain a four piece solid golf ball. The ingredients of the resin composition are shown in Table 1. The shore D hardness of the cover is shown in Table 2.

The resulting golf ball was subjected to evaluations in flight performance (i.e. launch angle, spin amount and flight distance) and shot feel and the results are shown in Table 2.

The evaluation methods are explained hereinafter.

(1) Flight Distance

A driver (No. 1 wood club) was equipped with a swing robot available from True Temper Co. and a golf ball was hit at a head speed of 40 m/sec to determine a flight distance of carry. The term "carry" means a distance travelled by the golf ball before bouncing first time on the ground.

(2) Launch Angle and Spin Amount

As explained in flight distance, a driver was equipped with a swing robot and a golf ball was hit at a head speed of 40 m/sec. Photographs of the impact point between the ball and the club were taken in a short period of time by two cameras. The launch angle and spin amount were determined from the photographs.

(3) Shot Feel

A professional golfer evaluated the golf ball by actually hitting with a driver (No. 1 wood club). The criteria of shot feel are as follow.

Good: Soft and good

Poor: Hard and bad

TABLE 1

| | Examples | | | | | |
|---|---|---|---|---|---|---|
| | 1 | 2 | 3 | 4 | 5 | 6 |
| Center | | | | | | |
| BR11*1 | 100 | 100 | 100 | 100 | 100 | 100 |
| Zinc acrylate | 23 | 18 | 23 | 23 | 27 | 23 |
| Zinc oxide | 27.8 | 32.4 | 30.8 | 30.8 | 29.5 | 33.0 |
| Antioxidant*2 | 0.5 | 0.5 | 0.5 | 0.5 | 0.5 | 0.5 |
| Dicumyl peroxide | 2.0 | 2.0 | 2.0 | 2.0 | 2.0 | 2.0 |
| Diphenyldisulfide | 0.5 | 0.5 | 0.5 | 0.5 | 0.5 | 0.5 |
| Inner layer | | | | | | |
| Hi-milan 1605*3 | 50 | 50 | 50 | 50 | 50 | 50 |
| Hi-milan 1706*4 | 50 | 50 | 50 | 50 | 50 | 50 |
| Outer layer | | | | | | |
| BR-11 | 100 | 100 | 100 | 100 | 100 | 100 |

TABLE 1-continued

| | Examples | | | | | |
|---|---|---|---|---|---|---|
| | 1 | 2 | 3 | 4 | 5 | 6 |
| Zinc acrylate | 23 | 27 | 18 | 23 | 27 | 27 |
| Zinc oxide | 27.9 | 29.6 | 32.5 | 30.9 | 29.6 | 31.8 |
| Antioxidant | 0.5 | 0.5 | 0.5 | 0.5 | 0.5 | 0.5 |
| Dicumyl peroxide | 2.0 | 2.0 | 2.0 | 2.0 | 2.0 | 2.0 |
| Diphenyldisulfide | 0.5 | 0.5 | 0.5 | 0.5 | 0.5 | 0.5 |
| Cover | | | | | | |
| Hi-milan 1605 | 50 | 50 | 50 | 50 | 50 | 50 |
| Hi-milan 1706 | 50 | 50 | 50 | 50 | 50 | 50 |

*1BR-11: High cis-polybutadiene rubber available from JSR Co., Ltd. (1,4-cis-butadiene content = 96%)
*2Yoshinox 425 available from Yoshitomi Pharmaceutical Co., Ltd.
*3Hi-milan 1605: Ionomer resin of ethylene-methacrylic acid neutralized with sodium ion (Melt index = 2.8, Flexural modulus = about 300 MPa), available from Mitsui Du Pont Polychemical co., Ltd.
*4Hi-milan 1706: Ionomer resin of ethylene-methacrylic acid neutralized with zinc ion (Melt index = 0.8, Flexural modulus = about 260 MPa), available from Mitsui Du Pont Polychemical co., Ltd.

TABLE 2

| | Examples | | | | | |
|---|---|---|---|---|---|---|
| | 1 | 2 | 3 | 4 | 5 | 6 |
| Center | | | | | | |
| Diameter (mm) | 15.3 | 24.6 | 24.6 | 24.6 | 24.6 | 29.2 |
| JIS-C hardness | 75 | 65 | 75 | 75 | 78 | 75 |
| Inner layer | | | | | | |
| Thickness (mm) | 1.8 | 1.8 | 1.8 | 1.8 | 1.8 | 1.8 |
| JIS-C hardness | 95 | 95 | 95 | 95 | 95 | 95 |
| Outer layer | | | | | | |
| Thickness (mm) | 9.6 | 4.95 | 4.95 | 4.95 | 4.95 | 2.65 |
| JIS-C hardness | 75 | 78 | 65 | 75 | 78 | 78 |
| Cover | | | | | | |
| Thickness (mm) | 2.3 | 2.3 | 2.3 | 2.3 | 2.3 | 2.3 |
| Shore D hardness | 71 | 71 | 71 | 71 | 71 | 71 |
| Ball evaluation | | | | | | |
| Launch angle (°) | 12.25 | 12.55 | 12.30 | 12.40 | 12.25 | 12.45 |
| Spin amount (rpm) | 2650 | 2550 | 2630 | 2605 | 2650 | 2560 |
| Carry (yards) | 201.0 | 203.8 | 201.3 | 201.9 | 202.7 | 201.5 |
| Shot feel | Good | Good | Good | Good | Good | Good |

Examples 7 to 12

Preparation of a Center

A composition for center was prepared by mixing the ingredients shown in Table 3 using a mixing roller and then press-molded at 140° C. for 25 minutes, followed by press-molding at 165° C. for 8 minutes to form a center. The diameter and JIS-C hardness are shown in Table 4.

Formation of an Inner Layer of an Intermediate Layer

On the center, a rubber composition for inner layer was covered and then press-molded at 155° C. for 20 minutes. The ingredients of the rubber composition are shown in Table 3. The thickness and JIS-C hardness of the inner layer are shown in Table 4.

Formation of an Outer layer of an Intermediate layer

The inner layer-covered center obtained above was covered by injection molding with the resin composition for outer layer, of which ingredients were shown in Table 3. The thickness and JIS-C hardness of the inner layer are shown in Table 4.

Formation of a Cover

On the outer layer-covered center, a resin composition for cover was covered by injection molding and then painted thereon to obtain a four piece solid golf ball. The ingredients of the resin composition are shown in Table 3. The shore D hardness of the cover is shown in Table 4.

The resulting golf ball was subjected to evaluations in flight performance (i.e. launch angle, spin amount and flight distance) and shot feel and the results are shown in Table 4.

The evaluation methods are the same as conducted in Examples 1–6.

TABLE 3

| | Examples | | | | | |
|---|---|---|---|---|---|---|
| | 7 | 8 | 9 | 10 | 11 | 12 |
| Center | | | | | | |
| BR-11*1 | 100 | 100 | 100 | 100 | 100 | 100 |
| Zinc acrylate | 23 | 23 | 20 | 23 | 23 | 23 |
| Zinc oxide | 23.4 | 34.5 | 35.5 | 34.5 | 23.4 | 20.0 |
| Antioxidant*2 | 0.5 | 0.5 | 0.5 | 0.5 | 0.5 | 0.5 |
| Dicumyl peroxide | 2.0 | 2.0 | 2.0 | 2.0 | 2.0 | 2.0 |
| Diphenyldisulfide | 0.5 | 0.5 | 0.5 | 0.5 | 0.5 | 0.5 |
| Inner layer | | | | | | |
| BR-11 | 100 | 100 | 100 | 100 | 100 | 100 |
| Zinc acrylate | 28 | 28 | 31 | 31 | 28 | 31 |
| Zinc oxide | 21.7 | 33.1 | 32.1 | 32.1 | 21.7 | 17.1 |
| Antioxidant | 0.5 | 0.5 | 0.5 | 0.5 | 0.5 | 0.5 |
| Dicumyl peroxide | 2.5 | 2.5 | 2.5 | 2.5 | 2.5 | 2.5 |
| Diphenyl disulfide | 0.5 | 0.5 | 0.5 | 0.5 | 0.5 | 0.5 |
| Outer layer | | | | | | |
| Pandex T-7890N*6 | — | — | — | — | 100 | 100 |
| Elastran ET 890*7 | 100 | — | — | — | — | |
| AT 015*8 | — | 20 | 15 | 17.5 | — | — |
| HG 252*9 | — | 60 | 45 | 52.5 | — | — |
| Surlyn AD 8511*10 | — | 10 | 20 | 15 | — | — |
| Surlyn AD 8512*11 | — | 10 | 20 | 15 | — | — |
| Tungsten powder | — | — | — | — | — | 11.9 |
| Cover | | | | | | |
| Hi-milan 1605 | 50 | 50 | 50 | 50 | 50 | 50 |
| Hi-milan 1706 | 50 | 50 | 50 | 50 | 50 | 50 |

*6Polyurethane thermoplastic elastomer available from Dai Nippon Ink & Chemicals Co., Ltd.
*7Polyurethane thermoplastic elastomer available from Takeda Verdish Urethane Co., Ltd.
*8Styrene-butadiene-styrene block copolymer having polybutadiene block with epoxy groups, having JIS-A hardness of 67, styrene/butadiene weight ratio of 40/60 and epoxy content of about 1.5 to 1.7% by weight, available from Daicel Chemical Industries Ltd.
*9Hydrogenated styrene-isoprene-styrene block copolymer having a terminal OH, having JIS-A hardness of 80 and styrene content of about 40% by weight, available from Kuraray Co., Ltd.
*10Ionomer resin of ethylene-methacrylic acid neutralized with zinc ion, having a melt index of 3.4 and a flexural modulus of about 220 MPa, available from Du Pont Co.
*11Ionomer resin of ethylene-methacrylic acid neutralized with sodium ion, having a melt index of 4.4 and a flexural modulus of about 280 MPa, available from Du Pont Co.

TABLE 4

| | Examples | | | | | |
|---|---|---|---|---|---|---|
| | 7 | 8 | 9 | 10 | 11 | 12 |
| Center | | | | | | |
| Diameter (mm) | 15.3 | 20.8 | 20.8 | 24.6 | 20.8 | 20.8 |
| JIS-C hardness | 75 | 75 | 67 | 75 | 75 | 75 |

TABLE 4-continued

| | Examples | | | | | |
|---|---|---|---|---|---|---|
| | 7 | 8 | 9 | 10 | 11 | 12 |
| Inner layer | | | | | | |
| Thickness (mm) | 9.7 | 7.0 | 7.0 | 5.0 | 7.25 | 7.0 |
| JIS-C hardness | 80 | 80 | 83 | 83 | 80 | 83 |
| Outer layer | | | | | | |
| Thickness (mm) | 1.8 | 1.8 | 1.8 | 1.8 | 1.85 | 1.8 |
| JIS-C hardness | 62 | 62 | 71 | 66 | 64 | 65 |
| Cover | | | | | | |
| Thickness (mm) | 2.2 | 2.15 | 2.15 | 2.25 | 1.85 | 2.15 |
| Shore D hardness | 71 | 71 | 71 | 71 | 71 | 71 |
| Ball evaluation | | | | | | |
| Launch angle (°) | 12.2 | 12.3 | 12.6 | 12.25 | 12.3 | 12.55 |
| Spin amount (rpm) | 2670 | 2490 | 2520 | 2635 | 2605 | 2550 |
| Carry (yards) | 201.5 | 202.8 | 203.2 | 201.9 | 202.7 | 203.8 |
| Shot feel | Good | Good | Good | Good | Good | Good |

Examples 13 to 17

Preparation of a Center

A composition for center was prepared by mixing the ingredients shown in Table 5 and then press-molded at 140 ° C. for 25 minutes, followed by press-molding at 165° C. for 8 minutes to form a center. The diameter and JIS-C hardness are shown in Table 6.

Formation of an Inner Layer of an Intermediate Layer

The center obtained above was covered by injection molding with the resin composition for inner layer, of which ingredients were shown in Table 5. The thickness and JIS-C hardness of the inner layer are shown in Table 6.

Formation of an Outer layer of an Intermediate Layer

The inner layer-covered center obtained above was covered by injection molding with the resin composition for outer layer, of which ingredients were shown in Table 5. The thickness and JIS-C hardness of the inner layer are shown in Table 6.

Formation of a Cover

On the outer layer-covered center, a resin composition for cover was covered by injection molding and then painted thereon to obtain a four piece solid golf ball. The ingredients of the resin composition are shown in Table 5. The shore D hardness of the cover is shown in Table 6.

Comparative Example 1

A golf ball was prepared as generally described in Examples 1 to 6, with the exception that the intermediate layer was not formed and the ingredients for the center, intermediate layer and cover were shown in Table 5

The resulting golf ball was subjected to evaluations in flight performance (i.e. launch angle, spin amount and flight distance) and shot feel and the results are shown in Table 6.

The evaluation methods are conducted as explained in Examples 1 to 6.

TABLE 5

| | Examples | | | | | Comp. |
|---|---|---|---|---|---|---|
| | 13 | 14 | 15 | 16 | 17 | Ex. 1 |
| Center | | | | | | |
| BR-11 | 100 | 100 | 100 | 100 | 100 | 100 |
| Zinc acrylate | 18 | 21 | 24 | 21 | 21 | 24 |
| Zinc oxide | 5 | 5 | 5 | 5 | 5 | 24.5 |
| Tungsten powder | 31.9 | 31.1 | 28.8 | 28.8 | 28.8 | — |
| Antioxidant | 0.5 | 0.5 | 0.5 | 0.5 | 0.5 | 0.5 |
| Dicumyl peroxide | 2.0 | 2.0 | 2.0 | 2.0 | 2.0 | 2.0 |
| Diphenyldisulfide | 0.5 | 0.5 | 0.5 | 0.5 | 0.5 | 0.5 |
| Inner layer | | | | | | |
| Hi-milan 1606 | 50 | 50 | 50 | 50 | 50 | — |
| Hi-milan 1706 | 50 | 50 | 50 | 50 | 50 | — |
| Pandex T-7890N*6 | — | — | — | — | — | 100 |
| Outer layer | | | | | | |
| Extran ET 880*12 | 100 | — | — | 100 | 100 | — |
| Mixtran E 375 *13 | — | 100 | 100 | — | — | — |
| Cover | | | | | | |
| Hi-milan 1605 | 50 | — | — | 50 | 50 | 50 |
| Hi-milan 1706 | 50 | — | — | 50 | 50 | 50 |
| IOTEC 7010*14 | — | 50 | 50 | — | — | — |
| IOTEC 8000*15 | — | 50 | 50 | — | — | — |

*12Polyurethane thermoplastic elastomer, available from Takeda Virdish Co., Ltd.
*13Polyurethane thermoplastic elastomer, available from Japan Miractran Co., Ltd.
*14Ionomer resin of ethylene-acrylic acid neutralized with zinc ion, having a melt index of 0.8, a flexural modulus of about 160 MPa and a Shore D hardness of 57, available from Exxon Co.
*15Ionomer resin of ethylene-acrylic acid neutralized with sodium ion, having a melt index of 0.8, a flexural modulus of about 370 MPa and a Shore D hardness of 57, available from Exxon Co.

TABLE 6

| | Examples | | | | | Comp. |
|---|---|---|---|---|---|---|
| | 13 | 14 | 15 | 16 | 17 | Ex. 1 |
| Center | | | | | | |
| Diameter (mm) | 31.5 | 31.5 | 31.5 | 33.3 | 34.5 | 35.3 |
| JIS-C hardness | 62 | 67 | 75 | 66 | 65 | 75 |
| Inner layer | | | | | | |
| Thickness (mm) | 1.8 | 1.8 | 1.8 | 1.0 | 1.0 | 1.85 |
| JIS-C hardness | 95 | 95 | 95 | 95 | 95 | 64 |
| Outer layer | | | | | | |
| Thickness (mm) | 1.6 | 1.6 | 1.6 | 1.0 | 1.0 | — |
| JIS-C hardness | 57 | 54 | 54 | 57 | 57 | — |
| Cover | | | | | | |
| Thickness (mm) | 2.2 | 2.2 | 2.2 | 1.7 | 2.0 | 2.3 |
| Shore D hardness | 71 | 72 | 72 | 71 | 71 | 71 |
| Ball evaluation | | | | | | |
| Launch angle (°) | 12.8 | 12.6 | 12.5 | 12.7 | 12.8 | 12.1 |
| Spin amount (rpm) | 2615 | 2645 | 2660 | 2605 | 2560 | 2730 |
| Carry (yards) | 204.2 | 203.5 | 202.8 | 203.8 | 202.5 | 200.3 |
| Shot feel | Good | Good | Good | Good | Good | Good |

As is apparent from the above Examples, the four piece solid golf balls of the present invention exhibit long flight distance and excellent shot feel.

What is claimed is:

1. A four piece solid golf ball comprising:

a center an intermediate layer having two layers consisting of an inner layer and an outer layer formed on the center, and a cover covering the intermediate layer, wherein the center has a JIS-C hardness of 65 to 80 and a diameter of 15–25 mm, the inner layer has a JIS-C hardness of 70 to 85 and a thickness of 2 to 13 mm, the outer layer has a JIS-C hardness of 40 to 80 and a thickness of 1.3 to 2.5 mm and the cover has a Shore D hardness of 62 to 72 and a thickness of 1.7 to 2.9 mm.

2. The four piece solid golf ball according to claim 1, wherein the inner layer and cover are harder than the center and the outer layer respectively, so that the hardness distribution of the portions is arranged soft-hard-soft-hard from the center to the cover.

3. The four piece solid golf ball according to claim 1, wherein the center and inner layer are both formed from vulcanized rubber, the outer layer is formed from thermoplastic elastomer or a mixture of thermoplastic elastomer and thermoplastic resin and the cover are formed from thermoplastic resin.

4. The four piece slid golf ball according to claim 1, wherein the inner layer has a thickness of 5.0 to 9.7 mm.

5. The four piece solid golf ball according to claim 1, wherein the inner layer is harder than the center by 5 to 20 in JIS-C hardness.

* * * * *